United States Patent [19]

Oder

[11] 4,005,008

[45] Jan. 25, 1977

[54] APPARATUS FOR MAGNETIC BENEFICIATION OF PARTICLE DISPERSION

[75] Inventor: Robin R. Oder, San Francisco, Calif.

[73] Assignee: J. M. Huber Corporation, Locust, N.J.

[22] Filed: July 25, 1975

[21] Appl. No.: 599,226

Related U.S. Application Data

[63] Continuation of Ser. No. 495,712, Aug. 8, 1974, abandoned.

[52] U.S. Cl. ..... 209/223 R; 209/232; 210/222

[51] Int. Cl.[2] ..... B03C 1/02

[58] Field of Search ..... 209/214, 223, 213, 232; 210/220, 223

[56] References Cited

UNITED STATES PATENTS

| | | | |
|---|---|---|---|
| 3,471,011 | 10/1964 | Iangricell | 209/214 |
| 3,551,897 | 10/1965 | Cooper | 209/106 X |
| 3,567,026 | 2/1971 | Kolm | 210/222 |
| 3,627,678 | 12/1971 | Marston | 209/214 X |
| 3,834,529 | 9/1974 | Mast | 209/1 |

OTHER PUBLICATIONS

IEEE, Trans. on Magnetics, vol. MAG–9, No. 3, Sept. 1973, pp. 303–306.

Chem. Abst, 70, 1969, 39880g.

*Primary Examiner*—Robert Halper

*Attorney, Agent, or Firm*—Harold H. Flanders; Guy E. Matthews

[57] ABSTRACT

Apparatus for effecting magnetic separation of magnetically attractable particles dispersed in a fluid carrier, as for example weakly magnetic discoloring contaminants dispersed in a clay slurry. The dispersion is passed through a ferromagnetic filamentatious matrix within a canister disposed in a magnetic field. The matrix is part of a magnetic separator system characterized by a separation parameter p, where p is a function of the geometry and magnetic and electrical properties of the separating apparatus; and of the rheological and magnetic properties of the dispersion. By determinately setting the controllable parameters associated with the aforementioned properties which effect p, a desired attenuation in the population of contaminant species is achieved. Optimized apparatus configurations are also disclosed, which configurations are based upon the discovered realtionships.

5 Claims, 9 Drawing Figures

TRANSMITTANCE FOR MAGNETIC SEPARATOR

BRIGHTNESS IMPROVEMENT ΔB VERSUS SEPARATION PARAMETER P

DENSITY DEPENDENCE OF BRIGHTNESS IMPROVEMENT FOR TWO CLAY FRACTIONS (H = 1.5 KILOOERSTEDS)

APPARATUS FOR MAGNETIC BENEFICIATION OF PARTICLE DISPERSION

This is a continuation of application Ser. No. 495,712 filed Aug. 8, 1974, now abandoned.

BACKGROUND OF INVENTION

This invention relates generally to the technology of magnetic separation, and more specifically to method and apparatus for removal of magnetically more susceptible minute particles, often present in minor concentrating as coloring impurities, from aqueous slurries of minute mineral particles — such as obtained by dispersing clay, e.g. a crude kaolin clay, in water.

The iron content of commercial deposits of kaolin clay is generally on the order of from approximately 0.2% to 2%. Even recent publications indicate a continuing dispute as to whether the iron contaminants are in discrete form or in a combined form within a kaolin lattice structure. While the form of this iron in clay has not been definitely established, recent evidence indicates that a portion is concentrated in or associated with non-kaolin contaminants such as titanium oxides, etc. Whatever its form, iron contamination reduces brightness in clay and the degree of discoloration of the clay generally increases with the amount of iron present.

In the foregoing connection, it has been known for some time that magnetically attractable contaminants can to a degree be removed from aqueous slurries of the aforementioned clays by imposition on the slurry of a high intensity magnetic field gradient. The forces produced upon the particles by the magnetic field gradient, effect differential movements of mineral grains through the field, in accordance with the magnetic permeability of the minerals, their size, mass, etc. The difficulties of utilizing magnetic separation are compounded in the present environment by the fact that the contaminants of greatest interest are of relatively low attractability. The primary magnetic discolorant found in Middle Georgia clays, for example, is iron-stained anatase ($TiO_2$). This impurity is very small in size and only very weakly magnetic. Indeed by some early views contaminants of the general type were considered to be non-magnetic. For example, see A. F. Taggart, *Handbook of Mineral Dressing*, p. 13–02 (1960), which shows on a scale of 100.00 taking iron as a standard, that the relative attractability of $TiO_2$ is 0.37.

In the copending patent applications of Joseph Iannicelli, Ser. No. 19,169, filed Mar. 13, 1970; Ser. No. 309,839, filed Nov. 27, 1972; and Ser. No. 340,411, filed Mar. 12, 1973, which applications are assigned to the assignee of the instant application, there are disclosed method and apparatus, which in comparison to the prior art, are outstandingly effective in achieving magnetic separation of the low susceptibility impurities referred to. In accordance with the disclosure of said applications, a container adapted to have the slurry passed therethrough is filled with magnetizable elements (preferably steel wool), constituting a flux conductive matrix, which matrix serves both for diverting the slurry flow into multitudinous courses, and for concentrating magnetic flux at myriad locations therein, so as to collect the weakly susceptible particles from the slurry. This container or canister, as it is referred to therein, is preferably of non-magnetic construction and disposed end-wise or axially between confronting surfaces of ferromagnetic pole members, between which a magnetic field having a high intensity is produced throughout the matrix. Preferably the said canister is generally cylindrical in form, and is oriented between the pole members with its axis vertical, its ends being adjacent to and covered by the pole members. In the first two of the cited Iannicelli applications, the flow of slurry through the canister and matrix is in the same general direction (i.e. axial) as the high intensity magnetic field. In the last listed of the said applications, it is disclosed that certain important advantages accrue from flowing the slurry through the canister in such manner that the predominant direction of flow through the matrix is radical, i.e. from the outside diameter (O.D.) thereof toward the axis, or from the axis toward the O.D.

The slurry, as taught in the said Iannicelli applications, is passed through the container at a rate sufficient to prevent sedimentation, yet slow enough to enable the collection and retention of weakly magnetic particles from the flow onto the matrix elements. The magnetic field which is applied during such collection, is taught in the said applications to have an intensity of at least 7,000 gauss, and preferably has a mean value in the matrix of 8,500 gauss or higher. At such field strengths magnetic saturation of the matrix occurs. After a sufficient quantity of magnetics are collected, slurry flow is discontinued, and with the field cut off the matrix is rinsed and flushed.

While the Iannicelli apparatus and method above-described have indeed been found highly effective for the desired purposes, it has nevertheless been observed in practice that apparatus and methods yielding a given set of results in a first environment would provide unanticipated (and in some instances, unacceptable) results in a differing environment. For example, a specific canister and matrix operating upon slurries having differing particle characteristics and different viscosities, might display unexpectedly poor results, even when the same field intensities and flow conditions were utilized. In consequence operation and design of systems of the described type, have up to the present time been based on trial and error, and on such guidance as could be provided by application of the intuitive sense. Such approach, however, has not enabled development of optimized systems, nor has it established correct modes of operation where trade-offs are required in the system operation.

For example, up to the present time, it has not been appreciated what options were available were one desirous in systems of the foregoing type of reducing retention time for the slurry in the separation (thereby increasing production rates), without sacrificing brightness in the resultant product. In the *Bulletin of the American Physics Society* Vol. 16 (1971) at page 350, for example, C. P. Bean reports an equation pertinent to removal of suspended particles in a fluid passed through a magnetic field, without however teaching any practical applications or limitations for the mathematical concepts mentioned.

In accordance with the foregoing, it may be regarded as an object of the present invention, to provide apparatus enabling optimization of magnetic separation of low magnetic susceptibility particles from dispersion of said particles in a fluid carrier, such as from aqueous slurries including comparatively larger numbers of non-magnetic particles.

It is a further object of the present invention, to provide apparatus for magnetic separation of low magnetic susceptibility discolorant particles from aqueous clay slurries, which fully utilizes the stagnation points in the flow pattern of slurry through separator, to augment collection of the said particles, and to enable flushing of said particles from the collection sites.

It is a further object of the present invention to provide an improved apparatus for magnetically removing discoloring contaminants from clay-water slurries, wherein the efficiency is so improved that it is not required to utilize magnetically saturated matrices.

It is another object of the present invention, to provide apparatus for magnetic separation of low magnetic susceptibility particles from aqueous slurries of said particles with comparatively larger number of non-magnetic particles, according to which determinative trade-offs may be provided among the controllable variables in the separation system, thereby tailoring the system performance characteristics to the materials being treated, to desired production rates, available magnetic field intensities, and so forth.

It is a still further object of the present invention, to provide apparatus for magnetic separation of low magnetic susceptibility particles from aqueous slurries of said particles, which enable commercially significant separations of the particles without having to employ a magnetically saturated matrix, thereby making possible large economies in magnet and operating costs.

SUMMARY OF INVENTION

Now in accordance with the present invention, it has been found that performance of separating systems of the type disclosed in the cited Iannicelli applications, by which it is meant reduction of discoloring magnetic contaminants and brightness improvement in the remaining product, is given in terms of a parameter $p$. This parameter, henceforth referred to as the "Separation parameter", is given by the expression:

$$(1)\ p = (Q/84)\,(d/D)^2\, M\, H\, \tau\, X\,(1-X),$$

where Q is the magnetic susceptibility and $d$ the means particle diameter of the attractable contaminant particles, $\nu$ is the viscosity of the fluid slurry including the particles, $M$ is the magnetization and $D$ the mean diameter of the filaments of the separation matrix, $X$ is the fraction of the canister volume occupied by the matrix, $H$ is the intensity of the applied magnetic field, and $\tau$ is the retention time in the said field. The parameter $p$ is related to the factor $C_o/C$, representing the inverse ratio of contaminant particles (C) entering the separation system to the particles ($C_o$) leaving the system, by the expression:

$$(2)\ C_o/C = e^{-\alpha p},$$

where $\alpha$ is a numerical coefficient characteristic of the system.

In accordance with one aspect of the invention the foregoing discovery is utilized by determinately selecting among the controllable variables of the separation system to yield a desired $C_o/C$ ratio. In a typical instance for example, the factors Q, $\nu$, M and $d$ are presented as essentially fixed quantities, so that a desired $C_o/C$ ratio is provided by selection among the controllable factors D, H, $\tau$, and X. The cited discovery, in another aspect of the invention, enables determinative trade-off as between the controllable variables, to provide a desired performance level. For example, assuming a desired $C_o/C$ ratio, it will be evident that trade-off among such factors as $\tau$ and $X$ is possible to yet provide the same $C_o/C$ value. The present discovery provides the method enabling each a proper trade-off.

In yet another aspect of the invention, the discovery enables apparatus optimized to remove contaminant particles of specific means size. In particular, packing densities and filament sizes for the utilized matrices may be specified in accordance with the invention as to be most effective for the particles sought to be removed. Thus, for example, it is found that filament sizes may be utilized in apparatus of the present type in accordance with the sizes of the particles sought to be removed.

In still another aspect of the invention, it has been found that superior results are achieved in the aforementioned separating apparatus, whereby the filamentatious material of the separator matrix has a predominant orientation for the filaments thereof, lying in a direction transverse to the applied magnetic field; and where the slurry to be treated is flowed through the matrix in a direction which is predominantly co-directional with the magnetic field. By means of such arrangement the surfaces of the filaments at which maximum magnetic force is present, coincide with surfaces whereat minimum viscous drag occurs. As a corrollary to this, it has further been found that the subsequent flushing flow which removes accumulated particles from the filaments, is preferably effected in a direction transverse to both the direction of slurry flow during collection and to the direction of the filaments themselves. This assures that maximum drag for flushing, is provided at the surfaces of the filaments whereat deposition of the particles has occurred.

BRIEF DESCRIPTION OF DRAWINGS

The invention is diagrammatically illustrated, by way of example, in the drawings appended hereto, in which.

DESCRIPTION OF PREFERRED EMBODIMENTS

For purposes of the ensuing description, reference will be had primarily to magnetic separating systems of the type described in the aforementioned Iannicelli applications. These systems are intended primarily for application to processes for magnetic beneficiation of clay slurries, and particularly of aqueous slurries of kaolin clays. It will, however, be appreciated by those skilled in the art, that the same basic methods and apparatus taught herein, are utilizable in magnetic separation of other systems wherein magnetically attractable particles are dispersed in fluid carriers. The technology of the invention may thus, for example, find application to hemoglobin separation, to waste separation and removal of attractable water pollutants, as well as to beneficiation of various mineral systems other than those of principal interest herein.

As has been previously indicated in connection with the "Background" portion of this specification, the separating systems to which the invention has application, are characterized by use of a container or "canister" in which is packed a matrix of ferromagnetic material, through which (in the presence of a magnetic field) the dispesion (typically an aqueous clay slurry) is caused to flow. This matrix is composed of multitudinous elongate ferromagnetic elements of strip, ribbon-like, or wire-like form. These materials are characterized by their relatively fine widths or diameter, and for purposes of the present specification, will hereinafter be collectively referred to as "filamentatious", or individually as "filaments". These filamentatious materials are packed in the container space with individual filaments contacting, yet also spaced from others, so that as the flow of the slurry proceeds through the container the slurry is diverted into multitudinous diverse courses of minute widths, as by being caused to flow tortuously to and fro in the container between and among the matrix-forming elements, while the flux of the magnetic field being applied is concentrated by the multitudinous elements and the angles and other surface irregularities of the matrix at myriad points in those sources. A preferred material of this type is steel wool, as for example a so-called "fine" or "medium" grade of commercially available No. 430 stainless steel wool. The steel wool matrix provides a relatively large amount of open space which, however, is so extensively interspersed by and between the wool, that the slurry is diverted into and through multitudinous flow courses having extremely narrow widths between the bordering magnetized strands of the wool. Accordingly, a relatively large volume of minute magnetic particles can be collected onto the strands before the flow of the slurry need be discontinued for flushing of the collected particles out of the canister.

Figure 1:
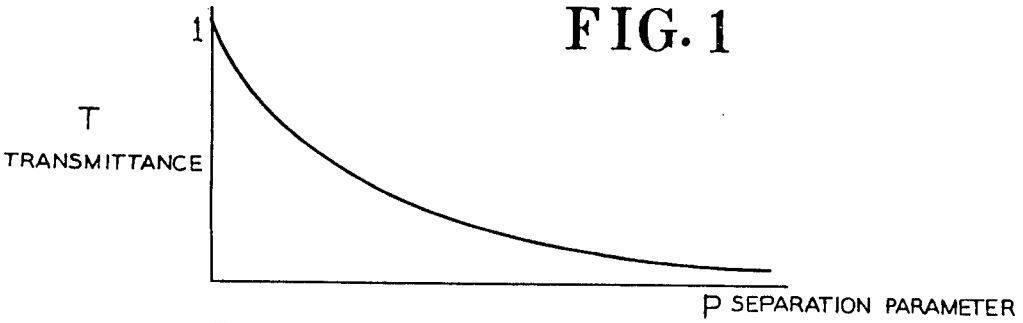
FIG. 1 is a graph, setting forth the dependence of the transmittance T of impurity particles through a separator system of the invention, as a function of the separation parameter, $p$.

In accordance with one aspect of the instant invention, it has been found that the complex effects of all the slurry, magnet and collection matrix variables, are expressible as the single separation parameter p, with a single exponential dependence for the transmittance $T = C_o/C$ of particles through the system. This effect is illustrated in the graph of FIG. 1 where T is plotted against $p$ for a value of $d$ provided by a typical separating system. The physical parameters of equation (1) above, can be regrouped so that $p$ is given as the product of three independent parameters:

$$(3)\ p = p_s\, p_m\, p_x\ ,$$

where $p_s$ is determined by the properties Q, $\nu$ and $d$ of the slurry; $p_m$ is determined by design characteristics of the magnet, and geometry of the system, that is the factor H and $\tau$; and $p_x$ is determined by the type and state of the collection matrix. As will become increasingly evident in the ensuing paragraphs, the discovered relationship enables the practitioner to determinatively provide trade-offs among the controllable variables in the separating system so as to yield an optimal or at least acceptable result, even under conditions previously deemed impractical for efficient operation — e.g., in the presence of high solids content for the slurry being treated. By thus suitably manipulating the variables of the system, $p$ can be made as large as is required for a given operation.

For clays of the type treated herein the dependence of brightness, B, upon the magnetic $TiO_2$ concentration C, approximates a linear relationship of the form:

$$(4)\ B = b - sC\ ,$$

where $b$ is the brightness upon total $TiO_2$ removal, and $s$ is the brightness reduction per unit increase of $TiO_2$ concentration. Using this expression, we can obtain a simple relationship between brightness, B$o$, and concentration, $C_o$, at the output of the separator system and those at the input, B and C, as follows:

$$(5)\ Bo - B \qquad \Delta B = sC(1 - C_o/C)$$

If the separator system could completely remove the magnetic contaminants, then the maximum brightness improvement would be $$(6)\ B_{max} = sC.$$

The more general expression for brightness improvement Δ B in clays derived from slurries treated in accordance with the invention is:

$$(7)\ \Delta B = \Delta B_{max}\,(1 - e^{-\alpha p}).$$

Figure 2:
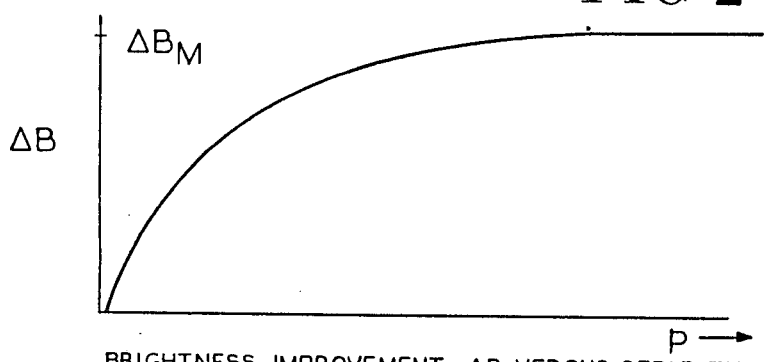
FIG. 2 is a graph, depicting theoretical brightness improvement in a clay treated in accordance with the invention, as a function of the separation parameter, $p$.

The function Δ B is plotted in FIG. 2 as a function of $p$. This figure shows that as the parameter $p$ is increased, the brightness will increase, and will asymptotically approach $B_{max}$.

The parameter $p_s$ in equation (3) above, shows the roles of the magnetic and rheological properties of the clay (or other) slurry, and is given by:

$$(8)\ p_s = (Q_d 2/n)$$

In this expression, $Q$ is the magnetic susceptibility of the magnetic fraction of the slurry, $d$ is the equivalent mean diameter of the magnetic particles, and $\nu$ is the slurry viscosity at the solids concentration and temperatures employed. The parameter $p_s$ is generally determined by the type of clay (or other dispersion) being processed. Since the larger the parameter $p_s$ is the better the separation, it will be seen that with all other things being equal a coarse fraction will respond to separation better than a fine fraction. In general, it will be evident that in performing a separation, the parameter $p_s$ is a presented quantity, not as readily controllable as the other factors to be discussed.

It will also be noted in reviewing equation (3) that $p$ is proportional to the factor $\tau(1-X)X/\nu$. In this connection it is pointed out that clays treated in the past by magnetic separating apparatus, have principally been characterized by low percentage solids (typically to about 30%). The factor $\tau X/\nu$, however, prescribes a technique for processing much higher solids content slurries (e.g. up to about 60%). In particular one may compensate for the rapid increase in $\nu$ as the solids content goes up, by increasing $\tau$ or X to maintain a desired $p$. Since as a practical matter an undue increase in $\tau$ will hamper the production rate for the processing of the clay, it will usually be desirable to effect the adjustment through X.

The role of magnet design and system geometry is reflected in the parameter $p_m$, given in terms of magnetic field intensity H, and retension time $\tau$, as:

$$(9)\ p_m = H\tau$$

Generally speaking, optimum performance is achieved with high field strength and a long retention time. The magnetic field and retention times, however, are selected consistent with desired brightness performance, commercial production rates, and power consumption. More specifically, for a selected brightness value, it is normally desired to maximize production rate and minimize power consumption. If it is assumed that the slurry and matrix properties are fixed, the brightness will be determined by the value of $p_m$. Here it can be shown, to a first approximation, that the power per unit production rate, $\dot{W}$, is given by $$(10)\ \dot{W} = K\ (H/\delta)\ p_m,$$

where $K$ is a constant, and $\delta$ is the canister diameter — assuming for analysis a cylindrical geometry. This indicates that to minimize power at maximum production rate and fixed $p_m$, the ratio ($H\delta$) should be minimized.

Aside from demagnetizing effects on the wool, most efficient separation is thus effected at as low a field as practicable in a low aspect ratio canister. Recalling, however, that we desire $p_m = H\tau$ to remain fixed, a decrease in H must be compensated by an increase in $\tau$. Effectively therefor power consumption and production can pursuant to this analysis be traded off against one another.

In general, it will be appreciated that the parameters $p_s$ and $p_m$, are for most practical purposes fixed by the physical attributes of the separation system — such as e.g. the geometry and electrical design characteristics thereof —, and by the rheological properties of the dispersion to be treated thereby. Thus as a practical matter, it is the parameter $$P_x = \frac{MX(1-X)}{D^2} \qquad (11)$$

of the collection matrix, which most appropriately lends itself to determinative control in order to enable a desired performance level. In this connection it is firstly important to appreciate that the prior art has principally contemplated that magnetic separation be conducted with the separation matrix maintained in a magnetically saturated condition. In accordance with the present inventive concept, however, it has been found that saturation need not necessarily be employed; rather the degree of saturation is regarded herein as a factor to be traded off — among other things against the attendant power requirements which may be required to provide the field necessary to yield saturation. In other words, under given conditions the required value of $p$ necessary to yield an adequate separation may be achieved with the matrix being less than saturated, with important attendant savings in utilized power. Further, however, it will be appreciated that the factor M in equation (11) will be determined once the external field is set and the choice of material for the matrix is made. The factors remaining in the expression (11) are the elements X(1−X) and $1/D_2$. It is these contained parameters, namely, the fraction X of canister volume occupied by the matrix material, and the mean filamentary diameter D (assuming a wire-like material such as steel wool), which are most readily controlled.

Concisely, it will be evident from the forgoing that densely packed fine-sized filamentatious material is preferred where high level separation is sought. The response of different clay fractions, e.g., is given in terms of the quantity $X(dD)^2$. In Table I, estimated values are given for $^X(d/D)^2$ for three types of clay fractions: "CWF", "Hydratex" and "Hydragloss" (all products of the assignee corporation):

Table I

RELATIVE SEPARABILITY FOR VARIOUS CLAY FRACTIONS

Table I

RELATIVE SEPARABILITY FOR VARIOUS CLAY FRACTIONS

| | CWF | Hydratex | Hydragloss |
|---|---|---|---|
| Average Particle Diameter (microns) | 3 | .8 | .3 |
| Magnetic Susceptibility ($10^{-6}$cgs/gm) | 22.6 | 8.4 | 8.6 |
| Relative Separability | 263 | 6.9 | 1.0 |

It will be seen from Table I that a "CWF" fraction is about 250 times more separable than a Hydragloss" fraction, and about 40 times more so than a "Hydratex" fraction. In Table I the practicles assumed to be attracted for separation are, of course, the $TiO_2$ particles previously discussed. Recent findings, on the other hand, indicate that montmorillonite particles may indeed be a source of at least part of the discoloring contaminants. These latter particles are very feebly magnetic and have a smaller equivalent diameter d than do the assumed anatase particles. Table I therefore shows that these montmorillonite particles are not easily removed unless the separation parameter $p$ is raised substantially above values used in the past.

The simplest and most economical manner in which $p$ may be increased, is by utilizing densely packed, fine matrix material. The finer the particles to be separated, in general the finer should the filament material be for maximum efficiency of operation, except that (for reasons that will be seen subsequently herein) the filament size diameter should be preferably no smaller than the diameter of the particles to be removed. The effect of packing volume, X, appears in the separation parameter as X(1−X). It will be evident that ( $\alpha p/\alpha X$) = o, where X = ½, and it is therefore seen that magnetic separation efficiency theoretically increases up to packing volume of 50%, at which the function $p = f(X)$ maximizes.

Figure 3:
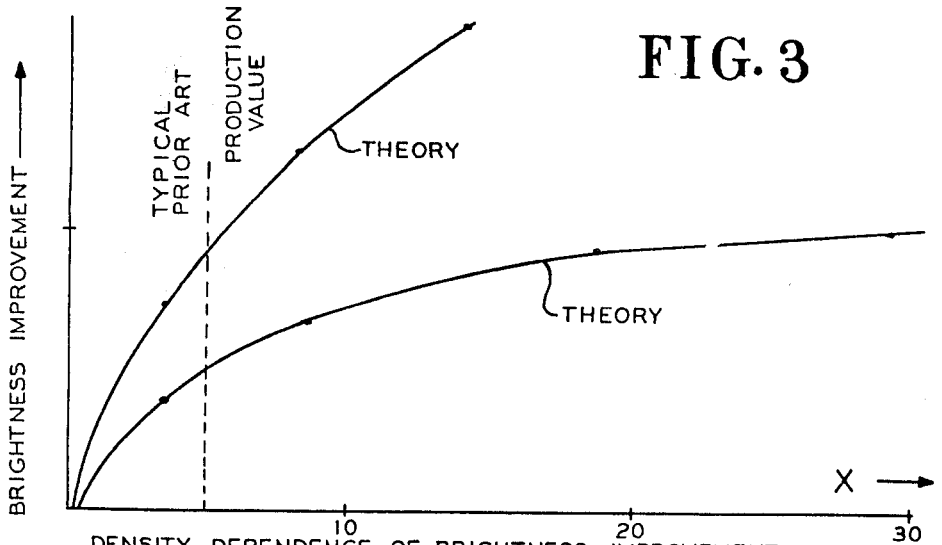
FIG. 3 is a graph, illustrating the effects of packing volume X upon brightness improvement, for a representative clay.

Measurements of the dramatic effect of packing volume upon brightness improvement are compared with theory in FIG. 3. The measurements therein (indicated by the "points") were made on CWF (upper curve) and Hydrafine (lower curve) fractions in a relatively low field environment. The solid line in each instance is plotted on a theoretical basis, and it will be evident that the measured values are very close to prediction. The vertical line identified as "prior art production value" indicates approximate levels of packing used in the past (typically about 5%). It will be clear that these prior utilized levels are far below those contemplated by the present invention. In practice, difficulty of cleanout of the matrix increases with increasing packing volume. This is particularly true for the coarser clay functions. Densely packed, finely filamented matrices are therefore preferably reserved for use where, indeed, fine particles are required to be separated.

The dramatic effect of matrix material volume packing, upon production rate is shown in the following Table II

TABLE II

BRIGHTNESS VERSUS RETENTION TIME FOR THREE PACKING VOLUMES

TABLE II

BRIGHTNESS VERSUS RETENTION TIME FOR THREE PACKING VOLUMES

| | Brightness* | | |
|---|---|---|---|
| Retention Time (Min.) | 2 | 4 | 8 |
| Packing Volume (%) | | | |
| 4.4 | 87.5 | 88.7 | 89.9 |
| 8.7 | 88.9 | 90.2 | 90.3 |
| 15.5 | — | 89.9 | 89.9 |

*Control Brightness - 84.3
Magnetic Field - 15 koe

In this Table, all brightness data refer to measurements made according to the standard TAPPI procedure T646m-54. This Table illustrates that production rate (i.e. reduction in retention time) can be increased by increasing packing volume X, without sacrificing brightness. It will be noted in this connection, that the elements on diagonals connected by arrows are equal in value to within experimental error (0.3 brightness points). This shows, for example, that upon increasing packing volume from 4.4% to 8.7% (almost double), retention time can be decreased from 4 to 2 minutes at the same brightness. Similar examples of increased production rate are to be found in the Table. The effect thus illustrated can be readily understood from the equation (1). Other things being equal, the separation parameter $p$ is given by $$(12)\ p \approx X(1-X)\tau$$

If the retention time $\tau$ is decreased so as to just compensate for the increase in the quantity $X(1-X)$ arising from increase in packing volume X, keeping $p$ constant, then the brightness will remain constant.

Figure 4:
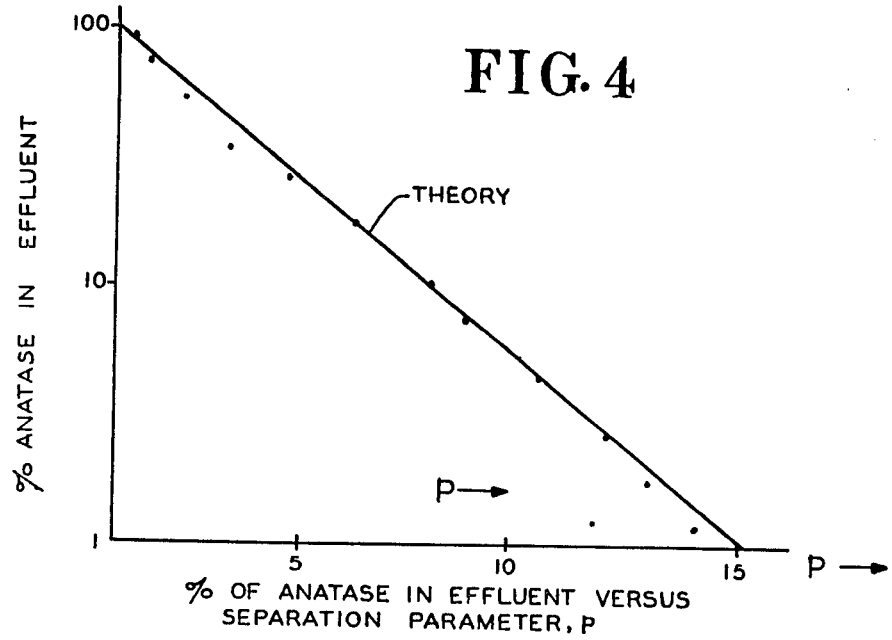
FIG. 4 is a graph of theoretical and experimental data showing the percentage of anatase removed from a representative clay, as a function of the separation parameter, $p$.
Figure 5:
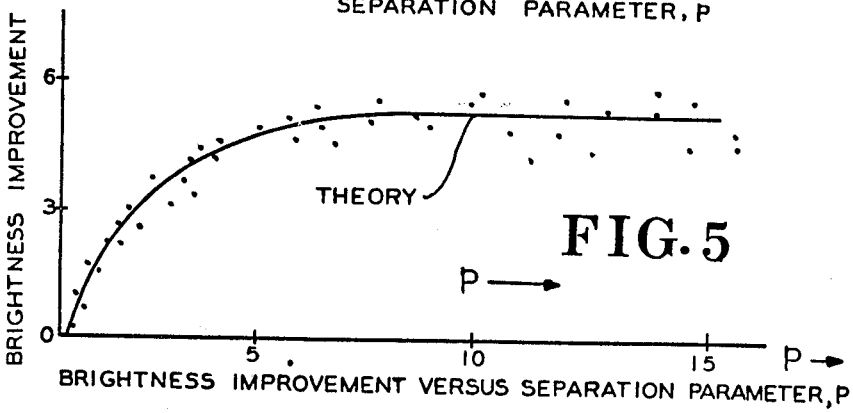
FIG. 5 is a graph showing corresponding brightness improvement for the clays represented in FIG. 4.

The overall control of brightness levels which may be achieved by application of the present invention to magnetic beneficiation of clays is illustrated in the graphical depictions of FIGS. 4 and 5 herein. In the first of these graphs the percentage of anatase in an effluent Hydrafine clay slurry subjected to processing by apparatus of the type considered herein, is shown as a function of the separation parameter $p$. The line unidentified as "theoretical", represents theoretical values derived from equation (1). The various plotted points adjacent the said line indicate measured values — which are seen to be very close to the theoretical values. This data was, in particular, obtained by varying the magnetic field intensity H, the retention time in the field, and the density X of the matrix material (a steel wool) in the canister. The measurements were made on a Hydrafine clay fraction employing matrices of a single wool size. It is important to note in FIG. 4 that any given value of the separation parameter $p$ could have been achieved in several different ways. For example, the value $p = 10$ might have been achieved with a 10 kilooersted field, one minute retention time through a 1% matrix. Or, it could have come from a 1 koe field, 10 minutes retention time and 1% matrix, or so forth (the given figures being intended only to illustrate the principle). It is only determined that the product of the variables shall have the value 10 in this example.

In FIG. 5, a graphical depiction sets forth the improvement in brightness of the effluent clay of FIG. 4, over that of the input, as a function of the separation parameter $p$. A Hydrafine control of brightness 84.4 (TAPPI scale) was used as a control in these tests. As in FIG. 4 the solid line identified as theoretical sets forth theoretical improvement based on equation (1). The plotted points closely adjacent the said line indicate measured values for the cited Hydrafine fraction. It will be evident from the graph, that brightness of over 90 were readily achieved.

Greater brightness increases can be achieved utilizing the magnetic separation techniques discussed herein, where multiple-pass operations are utilized, particularly where the matrix is flushed between passes. This, it may be observed, is a finding contrary to the single-pass techniques which in the past were predominantly used. Thus, a higher brightness improvement is achieved by two passes of a slurry at 40 gpm through the magnetic separator, than where one pass at 20 gpm is used. In order to illustrate this result, the Table III below, sets forth the brightness improvement for two types of coating clays, as a function of number passes through apparatus of the type disclosed in the aforementioned Iannicelli application. In each instance the same overall production rate was utilized. The said apparatus was operated during these tests with a field of 10,000 oersted, and a 5.5% packed matrix of 430 stainless steel medium felt wool served as the separating matrix:

TABLE III

RELATIONSHIP BETWEEN NUMBER OF PASSES AT OVERALL PRODUCTION RATE (1.00TPH) AND BRIGHTNESS IMPROVEMENT

| Clay utilized | No. 2 Coating Clay | No. 1 Coating Clay |
|---|---|---|
| Control Brightness | 83.00 | 83.95 |
| Brightness Improvement of Composite After: | | |
| 1 pass (1.0TPH) | 3.45 | 2.50 |
| 2 passes (2.0TPH each) | 3.80 | 3.10 |
| 4 passes (4.0TPH each) | 4.30 | 4.05 |
| 8 passes (8.0TPH each) | 4.10 | 3.95 |

It may be noted in connection with Table III, that the designations "No. 1" and "No. 2" coating clays, are in accordance with standard practice in the industry where the three most widely recognized coating grade clays are respectively characterized as to fineness as No. 1, with particle size 92% — 2 microns (i.e. 92% by weight of the particles have an equivalent spherical diameter less than 2 microns); No. 2, with particle size 80% — 2 microns, and No. 3, with particle size 72% — 2 microns. It will be understood that all of these designated standard coating clays (without limitation) may be processed by the apparatus and methods of the present invention.

Figure 6A:
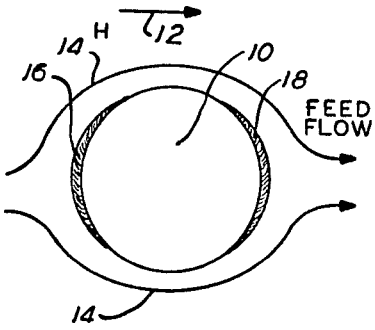
FIG. 6A schematically depicts a preferred filament orientation, with respect to magnetic field direction and slurry flow, to achieve optimum collection of magnetics.

The magnetic discoloring impurities removed by the present separating system, are collected on surfaces of the ferromagnetic filaments where the magnetic force of attraction is a maximum, and the viscous drag arising from flow, a minimum. The steel wool and similar matrices used in the past have generally been designed with randomly arranged filaments, in consequence of which much of the optimum collection surfaces are lost. In accordance with the present invention, however, the filaments are preferably laid down in such manner that they present a relatively regular array, which is predominantly transverse to the magnetic field. This arrangement is schematically depicted in FIG. 6A where a cross-section appears of a filament 10 of the collection matrix. Such filament is seen to be perpendicular to the applied field H, indicated by arrow 12. According to a further aspect of the invention, the flow of slurry (or other dispersion) through the matrix is such that, as indicated by arrows 14, the flow is codirectional with the magnetic field. The net result of this arrangement is that the magnetic particles will tend to collect at the areas 16 and 18 at the leading and trailing edges of filament 10, where the surfaces of maximum magnetic force coincide with minimum viscous drag — i.e. the said edges are stagnation points in the flow pattern. The schematic depiction of FIG. 6A is also useful in understanding why, as has previously been mentioned, it is preferable that the filament diameter in the separation matrix be no smaller than the diameter of the particles to be removed. In particular it will be evident from review of the Figures that as the particles become larger than the filament size, the flow above the filament cross-section becomes asymmetric in consequence of which the viscous forces tending to drag off the particles collected at areas 16 and 18, become more pronounced.

Figure 6B:
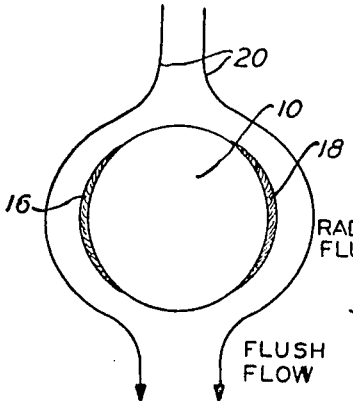
FIG. 6B schematically depicts a preferred flow direction for flushing the collected magnetics from the filaments of FIG. 6A.

Cleanout of filaments oriented in the separation system in accordance with FIG. 6A, is preferably carried out as schematically illutrated in FIG. 6B, with the field, H, extinguished. In particular it is seen therein that flush flow 20 is effected so that such flow is transverse to both the feed flow and filament length directions. This assured that the filament surfaces whereat maximum drag for the flush water flow occurs, correspond to the areas 16 and 18 at which most of the impurities have collected. In order to achieve a flush flow transverse to the feed flow one may initially provide a predominantly axial flow during the feed of slurry, as by introducing and withdrawing the slurry flow during from opposite ends of the canister in the manner set forth in the cited Ser. No. 340,411 Iannicelli application. The flush flow may then be rendered predominantly radial, as by introducing it through a perforated tube coaxial with the canister. This latter type of arrangement is e.g. shown in the cited Ser. No. 340,411 Iannicelli application. Suitable valving shifts the flow between the two configurations.

The preferentially arranged matrices described may comprise various arrangements such as layers of fine filamentary wires, each layer consisting of a sheet of generally codirectionally extending fine filaments held by a fine fabric network. Similarly steel fibers provided with the desired preferential orientation for the fibers thereof can be manufactured by sintering processes, or by wire cloth weaving techniques.

Figure 7A:
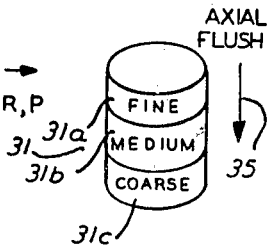
FIGS. 7A and 7B schematically depict two differing types of graded density matrices useful in connection with the invention.
Figure 7B:
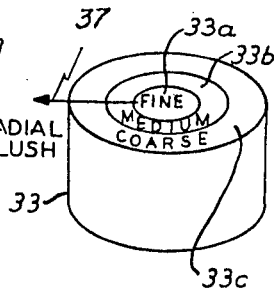

In FIGS. 7A and 7B highly schematic views appear of separation matrices 31 and 33, formed overall of filamentatious material such as steel wool. These matrices are, of course, during use normally contained within a canister of the type described throughout the course of the present specification. The matrices are characterized in being provided with successive zones which differ with respect to the fineness of filament size therein. The matrix 31 is thus seen to include an uppermost cylindrical zone 31a of relatively fine filament size, a middle cylindrical zone 31b of medium filament size, and an underlying zone 31c of relatively coarse filament size. The arrangement set forth is particularly useful where an axial flush flow processing as indicated by arrow 35 in the direction of the coarser material is utilized, in that the flush flow proceeds toward increasingly open material, whereby the particles dislodged from the finer material tends to be more effectively swept outward from the points of collection. The slurry feed flow in FIG. 7A is preferably axial and in the direction opposite to arrow 35. This enables the flow to pass initially through the coarse zone **31*c* where the larger, more easily removed particles will come out. Therafter the smaller particles will be removed at zones 31*b* and 31*a*.** By this arrangement the matrix will not become choked by the bigger materials, which, rather come out at an early stage in the flow pattern.

A corresponding arrangement is seen in FIG. 7B for the case where the matrix 33 is divided into successive annular zones **33*a*, 33*b* and 33*c*** of decreasing fineness.

Here, in anology to the case described in FIG. 7A, the flush flow is assumed to be in the direction of arrow 37, i.e., radially outward from the finer to the coarser material, and the feed flow is preferably directed inwardly along a generally radial direction. It should, of course, be appreciated in connection with the foregoing, that various sequential combinations of axial and/or radial flows may be utilized. Thus, as indicated in connection with FIGS. 6A and 6B, it is preferred to employ transverse feed and flush flows where the filamentatious material is provided with the therein described preferential orientation.

While the present invention has been particularly set forth in terms of specific embodiments thereof, it will be understood in view of the instant disclosure, that numerous variations upon the invention are now enabled to those skilled in the art, which variations yet reside within the scope of the instant teaching. Accordingly, the invention is to be broadly construed, and limited only by the scope and spirit of the claims now appended hereto.

I claim:

1. In a system for effecting magnetic separation of magnetically attractable particles of magnetic susceptibility Q and mean diameter $d$ from a dispersion of viscosity $n$ of said particles in a fluid carrier, said system being of the type including a non-magnetic canister, means for generating a magnetic field of intensity H, means disposing said canister in said field, a ferro-magnetic filamentatious matrix within said canister, and means for flowing said dispersion through said canister and matrix, and providing a retention time of $\tau$ in said matrix; the improvement wherein:

said canister is packed with filamentatious material of magnetization M and filaments of generally circular cross-section with a mean filamentary diameter D, which material occupies a fraction X of said canister volume; said parameters M, D and X being selected in accordance with the relationship $C_o/C = e^{-\alpha p}$, where $\alpha$ is a numerical coefficient characteristic of the system, and $p$ is the system separation parameter and interrelates said parameters by the expression:

$$p = (n^Q (d/D)^2 \, M \, \tau \, H \, X \, (1-X).$$

2. A system in accordance with claim 1, wherein the filamentatious material of said matrix has a predominant orientation for the filaments thereof, in a direction transverse to said magnetic field; and wherein means for flowing said dispersion through said matrix is adapted to provide a predominant flow direction which is co-directional with said magnetic field, whereby the surfaces of said filaments at which maximum magnetic force is present coincide with the surface portion of said strands whereat minimum viscous drag occurs, thereby enabling maximization of pick-up of said particles.

3. A system in accordance with claim 2, wherein said mean filamentary diameter D is larger than the mean diameter $d$ of said particles.

4. A system in accordance with claim 1, wherein said matrix filamentatious material occupies up to 50% of the volume of said canister.

5. A system in accordance with claim 4, wherein said matrix material occupies approximately 50% of the volume of said canister, thereby maximizing $p$ as a function of X.

* * * * *

UNITED STATES PATENT OFFICE

CERTIFICATE OF CORRECTION

PATENT NO. : 4,005,008

DATED : January 25, 1977

INVENTOR(S) : Robin R. Oder

It is certified that error appears in the above-identified patent and that said Letters Patent are hereby corrected as shown below:

In Abstract, fifth line from bottom, "effect" should be -- affect --.

Column 1, lines 11-12, "concentrating" should be -- concentration --.

Column 3, line immediately below 40, equation (1) should be:

-- $p = \frac{Q}{\eta}(d/D)^2 \; M \; H \; \tau \; X \; (1-X)$ --.

Column 3, line 45, the Greek letter "ν" should be Greek letter -- η --.

Column 3, line 64, following "Q," the Greek letter "ν" should be Greek letter -- η --.

Column 4, line 29, "corrollary" should be -- corollary --.

Column 5, line 25, "dispesion" should be -- dispersion --.

Column 6, line 1, following "Q," the Greek letter "ν" should be the Greek letter -- η --.

Column 6, line 30, following "Bo — B" the following equivalent symbol should be inserted -- ≡ --.

Column 6, line 50, the equation should read: -- $P_s = \frac{Qd^2}{\eta}$ --.

Column 6, line 54, following "particles, and" the Greek letter "ν" should be Greek letter -- η --.

Column 6, line 66, following "τ(1-X)X/", the Greek letter "ν" should be the Greek letter -- η --, making the equation read: -- τ(1-X)X/η --.

Column 7, line 2, following "factor τX/", the Greek letter "ν" should be Greek letter -- η --, making the equation read: -- τX/η --.

UNITED STATES PATENT OFFICE

CERTIFICATE OF CORRECTION

PATENT NO. : 4,005,008

DATED : January 25, 1977

INVENTOR(S) : Robin R. Oder

It is certified that error appears in the above-identified patent and that said Letters Patent are hereby corrected as shown below:

Column 7, line 5, following "increase in" the Greek letter "$\nu$" should be the Greek letter -- $\eta$ --.

Column 7, line 34, following "ratio", "($H\delta$)" should be -- $\frac{H}{\delta}$ --.

Column 8, line 17, following "X(1-X) and" the equation should be -- $1/D^2$ --.

Column 8, line 27, following "quantity", the equation "$X(dD)^2$" should be -- $X(d/D)^2$ --.

Column 8, the following table headings were printed twice and one set should be omitted: "TABLE I RELATIVE SEPARABILITY FOR VARIOUS CLAY FRACTIONS"

Column 8, line 67, "$(\alpha p/\alpha X) = o$" should be -- $\frac{\partial p}{\partial X} = o$ --.

Column 9, line 19, the word "functions" should be -- fractions --.

Column 9, the following table headings were printed twice and one set should be omitted: "TABLE II BRIGHTNESS VERSUS RETENTION TIME FOR THREE PACKING VOLUMES".

Column 9, line 45, in footnote of table, "15 koc" should be -- 15 koe --.

Column 12, line 23, following "flow" the word "during" should be omitted.

Column 12, line 52, the word "processing" should be -- proceeding --.

Column 13, line 26, after "cosity", the italicized "*n*" should be the Greek letter -- $\eta$ --.

UNITED STATES PATENT OFFICE

CERTIFICATE OF CORRECTION

Patent No. 4,005,008 Dated January 25, 1977

Inventor(s) Robin R. Oder

It is certified that error appears in the above-identified patent and that said Letters Patent are hereby corrected as shown below:

Column 14, line 10, equation should read $$-- p = Q/\eta(d/D)^2 \; M \; \tau \; H \;\; X \; (1-X) \; --.$$

Signed and Sealed this

Twenty-eighth Day of June 1977

[SEAL]

*Attest:*

RUTH C. MASON
*Attesting Officer*

C. MARSHALL DANN
*Commissioner of Patents and Trademarks*